US005505132A

United States Patent [19]

Warren et al.

[11] Patent Number: 5,505,132

[45] Date of Patent: Apr. 9, 1996

[54] APPARATUS FOR FIELD POSTAGE STAMP CANCELLATION

[76] Inventors: David K. Warren, 23780 Rosalind, Eastpointe, Mich. 48021; Thomas L. Cudnik, 25934 Waldorf, Roseville, Mich. 48066

[21] Appl. No.: 417,512

[22] Filed: Apr. 3, 1995

[51] Int. Cl.[6] ..... B41K 1/00

[52] U.S. Cl. ..... 101/371; 101/28

[58] Field of Search ..... 101/368, 371, 101/372, 373, 28, 3.1, 4, 93, 41, 287, 327

[56] References Cited

U.S. PATENT DOCUMENTS

| | | | |
|---|---|---|---|
| 2,868,123 | 1/1959 | Martin et al. | 101/371 X |
| 4,537,128 | 8/1985 | Burroughs et al. | 101/368 X |
| 5,054,389 | 10/1991 | Kuhlman et al. | 101/28 |

FOREIGN PATENT DOCUMENTS 4-113612 4/1992 Japan .

OTHER PUBLICATIONS

Perma Stamp™ Catalog of Des Moines Stamp Mfg Co, pg. 12, Showing "Pocket Case" Product, Dated 1994.

Pre–Inked Cancellation Ink Stamp Used by U.S. Postal Service Date of 1st Use Unknown. Two Photos Thereof Supplied.

*Primary Examiner*—Christopher A. Bennett

*Attorney, Agent, or Firm*—Peter D. Keefe

[57] ABSTRACT

A field postage stamp cancellation apparatus composed of a pre-inked cancellation ink stamp which is resident in a specially structured lidded box. The lidded box is composed of a box and a lid hingably connected thereto. A bottom wall of the box is attached to the letter carrier's postal satchel. The hinge for the lid which is oriented more-or-less horizontally when the postal satchel is carried via its carrying strap in a normal manner, and is located at the lowermost location of the lidded box, whereby when the lid is opened, gravity naturally tends to continue swinging of the lid about the hinge until the lid depends downwardly therefrom and the lidded box is now open. A box wall extends from the bottom wall to a periphery, wherein the apex of each of the ridges of the cancellation ink stamp extend thereabove. The lid has a frictional fit and/or a snap fit with respect to the box wall. A touch tab is provided on the lid opposite the hinge to facilitate one handed opening of the lid. A weather protective lip is provided on the lid to minimize the chance of rain getting into the lidded box when it is closed. A letter carrier who notices that a mail piece has an uncancelled postage stamp need merely use one hand to flick open the lid, touch the postage stamp to the apices, and then reclose the lid.

20 Claims, 2 Drawing Sheets

APPARATUS FOR FIELD POSTAGE STAMP CANCELLATION

BACKGROUND OF THE INVENTION

1. Field of the Invention

The present invention relates to postal service cancellation of postage stamps, and more particularly to pre-inked stamps used for this purpose. Still more particularly, the present invention relates to an apparatus which allows a postal letter carrier to easily and effortlessly cancel postage stamps on mail pieces when in the field on foot delivering mail to addressees.

2. Description of the Related Art

Payment for mail is, in most cases, indicated on mail pieces, such as for example envelopes and postcards, by usage of one or more postage stamps affixed to the mail piece. The postal service cancels these stamps to indicate the stamps have been used and can no longer be used again. Cancellation of postage stamps is of paramount importance to the postal service. Unless the postal service cancels each and every stamp passing through its system, it risks addressors reusing stamps without detection, thus seriously eroding, or even collapsing, its funding base. Accordingly, it is essential for the postal service to ensure cancellation of the postage stamps affixed to each and every mail piece it handles through its system.

This postage stamp cancellation process may be automated or may be by hand; in any event, inevitably some pieces of mail get through sortation and delivery to the destination post office without the postage stamps thereof having been cancelled. The letter carrier who is charged with delivery of mail to addressees is the postal service's last line of control to ensure each and every postage stamp has been cancelled before it has been delivered to an addressee.

The postal service recognizes that a number of mail pieces having uncancelled stamps routinely appear (along with, of course, the vast majority of mail pieces having properly cancelled postage stamps) at the letter carrier's sortation station at the destination post office. To this end, the postal service provides a pre-inked cancellation ink stamp having a series of elongated ridges forming a series of spaced apices which provide a contact location with the postage stamps of a mail piece. The back of the cancellation ink stamp has a rear surface, opposite the ridges, which is adhesively affixed to some surface at the sortation station, such as a wall surface. Should the letter carrier detect a mail piece having an uncancelled stamp, the letter carrier simply touches the postage stamp to the apexes to thereby impart cancellation ink onto the postage stamp.

Unfortunately, when out in the field on foot delivering mail to addressees, the letter carrier who detects a mail piece having an uncancelled stamp is almost powerless to now, at this late juncture, cancel the postage stamp. Using a ballpoint pen to strike across the postage stamp is not only crude but generally ineffective and very cumbersome when carrying a satchel full of mail and a pack of ready to deliver mail in one hand. Using a pre-inked cancellation ink stamp out in the field is too messy to even consider unless it is somehow placed in a lidded box, analogously to a "pocket case" of Des Moines Stamp Mfg. Co. of Des Moines, Iowa. Nonetheless, even if the cancellation ink stamp is contained in a lidded box, it would be too awkward to be used by letter carriers when on foot delivering mail to addressees, since many dextrously demanding manipulations would be needed to find the lidded box, open it, place the mail piece into proper registration with the cancellation ink stamp so that the postage stamp does, in fact, get cancellation inked, close the lidded box, and then put the lidded box away somewhere. If soon thereafter another mail piece is again found to have uncancelled postage stamps, the letter carrier would, no doubt, trade the inconvenience of the lidded box for the crudeness of the ballpoint pen. The addressee would then, no doubt, be aghast at the unprofessional way in which the postal service has cancelled the postage stamp on his or her piece of mail.

The problem of mail pieces having uncancelled postage stamps reaching the letter carrier when out in the field will undoubtedly become acute when delivery-point-sequencing (DPS) is implemented by the postal service, wherein the letter carrier will only first see the mail pieces when out in the field; any last chance to detect and cancel postage stamps at the destination post office being then lost.

Clearly, a truly practical solution to the problem of field cancellation of postage stamps is greatly needed today and will be even more so tomorrow.

SUMMARY OF THE INVENTION

The present invention is an apparatus which affords letter carriers who are in the field to easily, effectively, and effortlessly cancel uncancelled postage stamps before they are delivered to addressees.

The field postage stamp cancellation apparatus according to the present invention is composed of a pre-inked cancellation ink stamp which is resident in a specially structured lidded box. The lidded box is composed of a box and a lid hingably connected thereto. The bottom wall of the box is attached to the letter carrier's postal satchel, preferably at an exterior surface thereof. The hinge for the lid which is oriented more-or-less horizontally when the postal satchel is carried normally via its carrying strap in a conventional manner, and is located at the lowermost location of the lidded box, whereby when the lid is opened, gravity naturally tends to continue swinging of the lid about the hinge until the lid depends downwardly therefrom and the lidded box is now open. A box wall extends from the bottom wall to a periphery, wherein the apex of each of the ridges of the cancellation ink stamp extend thereabove. The lid has a frictional fit and/or a snap fit with respect to the box wall. A touch tab is provided on the lid opposite the hinge to facilitate one handed opening of the lid. A weather protective lip is provided on the lid to minimize the chance of rain getting into the lidded box when it is closed.

In operation, a letter carrier who notices that a mail piece has an uncancelled postage stamp need merely use one hand to flick open the lid, touch the postage stamp to the apices, and then reclose the lid. The addressee sees only a professionally cancelled stamp, and the rhythm and concentration of the letter carrier is undisturbed by this simple, yet vitally important operation.

Accordingly, it is an object of the present invention to provide an apparatus for a letter carrier who is in the field to cancel postage stamps.

It is another object of the present invention to provide an apparatus for a letter carrier who is in the field to cancel postage stamps, wherein the cancellation operation is effortless and effective, and wherein the cancellation is professional looking.

These, and additional objects, advantages, features and benefits of the present invention will become apparent from the following specification.

DETAILED DESCRIPTION OF THE PREFERRED EMBODIMENT

Figure 1:
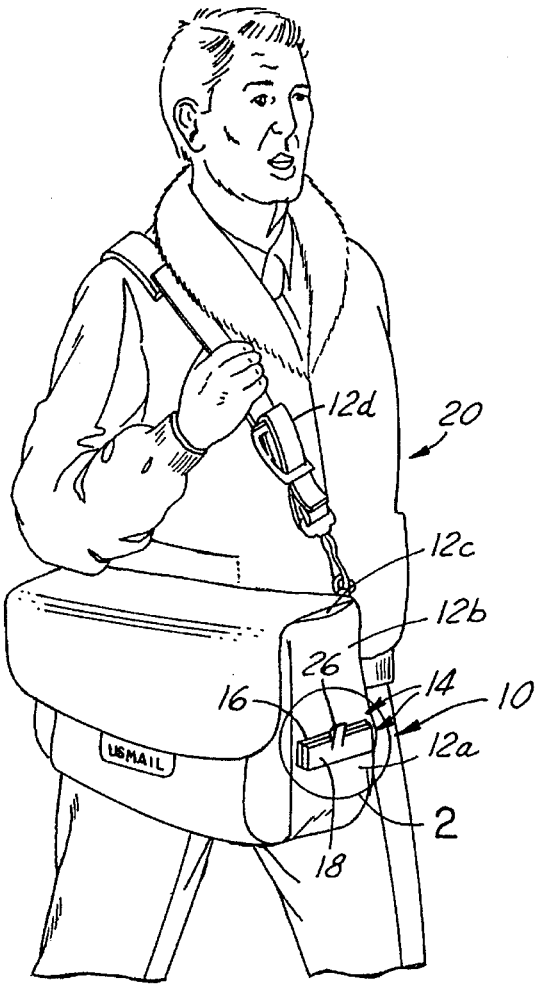
FIG. 1 is a perspective view of the field postage stamp cancellation apparatus according to the present invention, shown in operation with respect to a letter carrier's postal satchel.

Referring now to the Drawing, FIG. 1 depicts the field postage stamp cancellation apparatus 10 according to the present invention connected with an exterior surface 12*a* of a letter carrier's postal satchel 12. The field postage stamp cancellation apparatus 10 includes a lidded box 14 having a box 16 and a lid 18 hingably connected thereto. As can be readily discerned, the field postage stamp cancellation apparatus 10 is located on the postal satchel 12 so that it is very easy for the letter carrier 20 to use a single free hand to touch the lid 18 and thereby secure opening of the lidded box 14. As will become clear from the description hereinbelow, within the lidded box 14 is a cancellation ink stamp for use in the field by the letter carrier.

Figure 2:
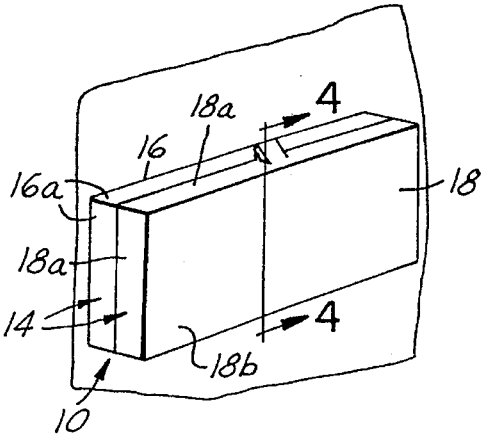
FIG. 2 is a perspective view of the field postage stamp cancellation apparatus, seen in circle 2 of Ffire 1 and shown in its closed configuration.
Figure 3:
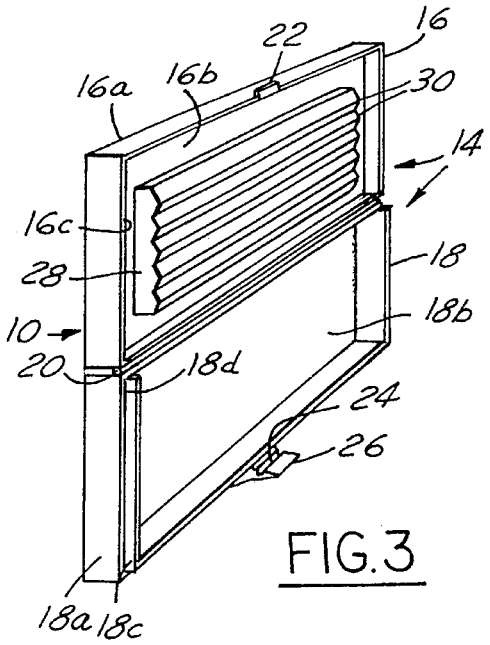
FIG. 3 is a perspective view of the field postage stamp cancellation apparatus, shown in its open configuration.

FIG. 2 shows the exterior of the lidded box 14 in a closed configuration, and FIG. 3 shows the lidded box in an open configuration. A hinge 20 hingably connects the lid 18 to the box 16, as shown in FIG. 3, and best shown in FIG. 4. The lidded box 14 is preferably formed of a light and rugged plastic material.

The box 16 has a box wall 16*a* and the lid 18 has a lid wall 18*a*. Each of the box wall 16*a* and the lid wall 18*a* meet abuttably when the lid 18 is closed upon the box 16, as shown in FIG. 2. The box 16 further has a bottom wall 16*b* integrally connected with the box wall 16*a*, while the lid 18 has a top wall 18*b* integrally connected with the lid wall 18*a*.

Figure 4:
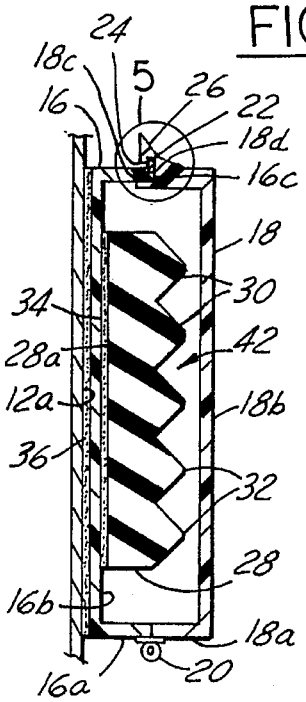
FIG. 4 is a partly sectional end view of the field postage stamp cancellation apparatus, seen along line 4—4 in FIG. 2.

The lid wall 18*a* is provided with a recessed portion that forms a lip 18*c* which emanates from a shelf 18*d*. As can be seen from FIG. 4, when the lid 18 is closed onto the box 16, the periphery 16*c* of the box wall 16*a* abuts the shelf 18*d* and the lip 18*c* overlaps the box wall, both features providing an excellent weather seal to keep moisture out of the lidded box 14 when it is closed. As shown in FIG. 4, the hinge 20 connects to the box wall 16*a* and to the lid wall 18*a*, the lid wall having little or no lip therealong.

Figure 5:
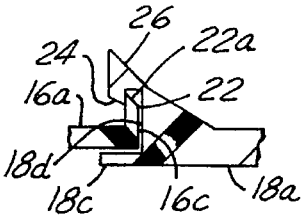
FIG. 5 is a detail view of a preferred sanp fit latch and boss combination of the field postage stamp cancellation apparatus, seen in circle 5 of FIG. 4.

While a friction fit of the box wall 16*a* with respect to the lid wall 18*a* is possible at the engagement of the lip 18*c* with the box wall, it is preferred for the lid wall to snap fit with respect to the box wall so that the opening of the lid 18 with respect to the box 16 will be easy and effortless and closure of the lid reproducible and reliable. As shown in FIGS. 4 and 5, the preferred snap fit is provided by a boss 22 located on the box wall 16*a* adjacent the periphery 16*c* thereof and a latch 24 located on the lid wall 18*a* adjacent the shelf 18*d* thereof, wherein each of the boss and latch are located opposite the hinge 20. As the lid 18 is closed upon the box 16, the latch 24 rides an an inclined surface 22*a* of the boss 22 and then resiliently engages the boss when the lid is closed on the box. A touch tab 26 is connected with the latch 24 to facilitate easy, one finger operation of the latch for releasing the sanp fit of the lid 18 from the box 16.

The aforementioned cancellation ink stamp 28, which is of preferably the known, conventional type of pre-inked cancellation ink stamp discussed in the Background of the Invention hereinabove and currently in use by the postal service, is resident in the box 16. The cancellation ink stamp 28 is fixedly (permanently or releasably) connected with the box 16 by preferably being connected with the bottom wall 16*b* of the box 16, as shown in FIGS. 3 and 4. In this regard, as shown in FIG. 4, an adhesive or a double-sided adhesive foam 34 adheres the bottom side 28*a* of the cancellation ink stamp 28 to the bottom wall 16*b*. The cancellation ink stamp 28 has a contoured contact surface 42 for providing a postage stamp cancellation ink mark on a surface brought into contact with it. In this regard, for example, an acceptable contoured contact surface 42 is in the form of a plurality of ridges 30, wherein each ridge 30 forms an apex 32 for imparting a postal cancellation ink mark on a surface, particularly, of course, one or more in line postage stamps affixed to a mail piece. As best understood from reference to FIG. 4, the location of the apices 32 is such that they extend further from the bottom wall 16*b* than does the periphery 16*c*; accordingly, when the lidded box 14 is in its open configuration as shown in FIG. 3, a surface can be brought into flat contact with the apices without the periphery (or the lid) interfering therewith.

As mentioned, the box 16 is conected with the postal satchel 12, the connection being by any suitable methodology. The preferred connection methodology, as shown in FIG. 4, is for the exterior of the bottom wall 16*b* to be provided with an adhesive or a double-sided adhesive foam 36 whereby the bottom wall is attached to an exterior surface 12*a* of the postal satchel 12 at a selected attachment location with respect thereto. The preferred attachment location is shown in FIG. 1 to be at the forward facing side 12*b* of the postal satchel 12, whereat conventional postal satchels have an internal hard backing plate which ideally provides location stiffening of the field postage stamp cancellation apparatus 10 with respect to the postal satchel 12 during cancellation usage thereof.

Preferably, the field postage stamp cancellation apparatus 10 is located on a vertically oriented surface of the postal satchel 12, such as the forward facing side 12*b*, when the postal satchel is oriented so that its opening 12*c* is essentially horizontal, such as being the case when the postal satchel is carried in a normal manner by the letter carrier 20 using the carrying strap 12*d* thereof as shown in FIG. 1. Preferably further, the field postage stamp cancellation apparatus 10 is oriented with respect to the postal satchel 12 such that the hinge 20 is more-or-less vertically (as defined by the direction of gravity) beneath the latch 24 when the postal satchel in carried in the aforesaid normal manner of FIG. 1. Accordingly, when the lid 18 is opened, gravity will carry the lid to a fully open position with respect to the box 16, and the letter carrier will not be bothered by the lid when performing a postage stamp cancellation.

Figure 6:
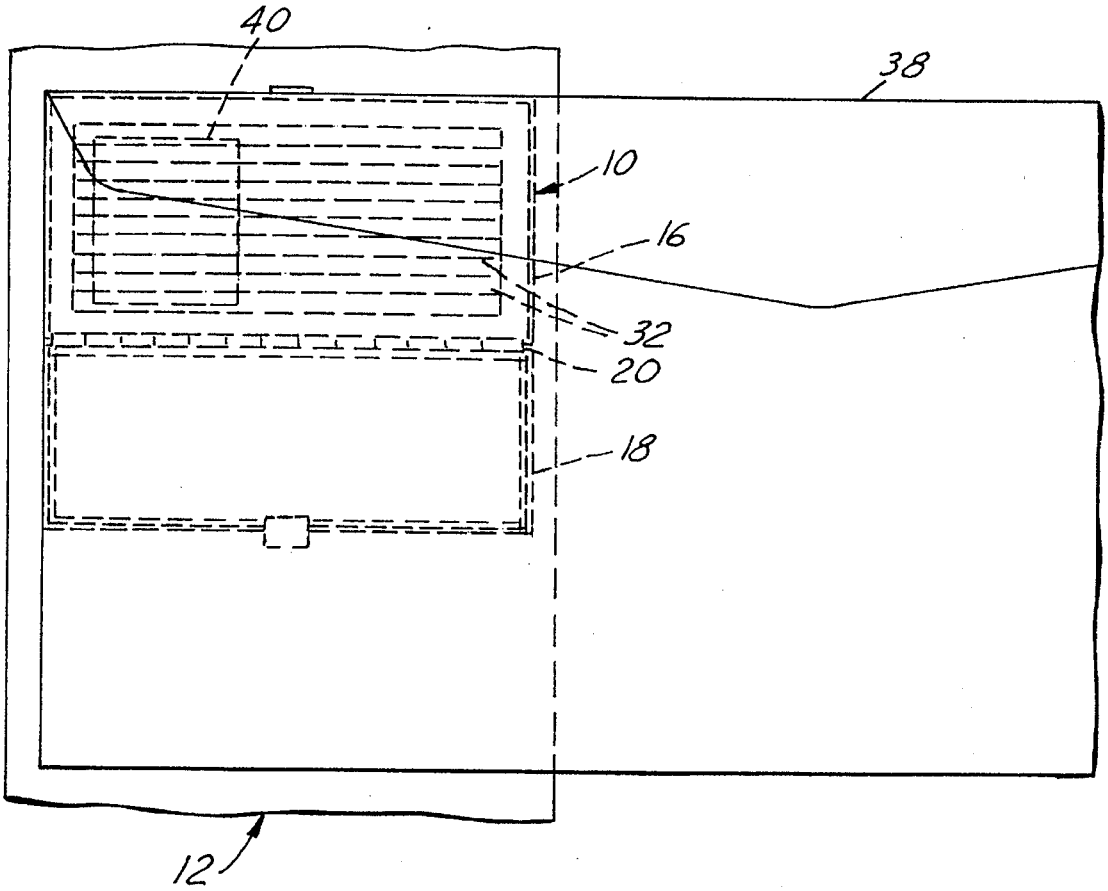
FIG. 6 is a plan view of the field postage stamp cancellation apparatus being used to cancel the postage stamp of a mail piece, wherein the field postage stamp cancellation apparatus is shown in phantom.

Operation of the field postage stamp cancellation apparatus 10 is effected by the letter carrier using a thumb or finger pushingly against the touch tab to thereby unlatch the latch and allow for the lid to swing open and depend from the hinge by action of gravity, whereupon the lidded box is in the open configuration of FIG. 3. Now as shown in FIG. 6, a mail piece 38 having one or more uncancelled postage stamps 40 is held by the letter carrier so that the postage stamps contact the apices 32 to thereby leave a professional appearing cancellation ink mark on the one or more postage stamps. The letter carrier now uses a single hand to flick-up the lid to near the closed configuration of FIG. 2 and then pat the top wall of the lid toward the box to thereby cause the latch to engage on the boss and thereby snap closed the lidded box.

To those skilled in the art to which this invention appertains, the above described preferred embodiment may be subject to change or mortification. Such change or modification can be carried out without departing from the scope of the invention, which is intended to be limited only by the scope of the appended claims.

What is claimed is:

1. A postage stamp cancellation apparatus for field use by a letter carrier carrying a postal satchel, said postage stamp cancellation apparatus comprising:

a lidded box comprising:

a box having a bottom wall and a box wall connected thereto;

a lid having a top wall and a lid wall connected thereto; and hinge means for pivotally connecting said box wall to said lid wall at a first selected location with respect thereto so that said lid is selectively openable with respect to said box whereupon said lidded box is selectively switchable from being in a closed configuration to being in an open configuration;

a pre-inked stamp connected with said box and at least in part located therewithin, said pre-inked stamp having a contoured contact surface for imparting a postage stamp cancellation ink mark on a surface brought into selected contact therewith when said lidded box is in said open configuration; and connection means for connecting said box to a postal satchel.

2. The postage stamp cancellation apparatus for field use of claim 1, wherein said box wall terminates in a periphery remote from said bottom wall; wherein further said contoured contact surface is located further from said bottom wall than said periphery is located from s aid bottom wall.

3. The postage stamp cancellation apparatus for field use of claim 2, further comprising snap means connected with said box wall and said lid wall at a second selected location opposite said first selected location for providing a releasable snap closure of said lid with respect to said box.

4. The postage stamp cancellation apparatus for field use of claim 3, wherein said snap means further comprises touch tab means connected with said lid wall for facilitating releasing of said snap closure.

5. The postage stamp cancellation apparatus for field use of claim 3, further comprising lip means connected with said lip wall for overlapping at least a portion of said box wall when said lidded box is in said closed configuration to thereby provide a weather seal between said box and said lid.

6. The postage stamp cancellation apparatus for field use of claim 5, wherein said connection means comprises adhesive means.

7. The postage stamp cancellation apparatus for field use of claim 5, wherein said pre-inked stamp has a bottom side; and wherein said bottom side is adhesively connected with said bottom wall of said box.

8. The postage stamp cancellation apparatus for field use of claim 5, wherein said contoured contact surface comprises a plurality of ridges, each ridge of said plurality of ridges terminating in an apex; wherein each said apex is located further from said bottom wall than said periphery is located from said bottom wall.

9. The postage stamp cancellation apparatus for field use of claim 8, wherein said snap means further comprises touch tab means connected with said lid wall for facilitating releasing of said snap closure.

10. The postage stamp cancellation apparatus for field use of claim 9, wherein said connection means comprises adhesive means; wherein said pre-inked stamp has a bottom side; and wherein said bottom side is adhesively connected with said bottom wall of said box.

11. A postage stamp cancellation apparatus and postal satchel combination for field use by a letter carrier, said combination comprising:

postal satchel means for carrying a plurality of mail pieces, said postal satchel means having an opening for accessing the pieces of mail being carried therewithin;

a lidded box connected with said postal satchel means, said lidded box comprising:

a box having a bottom wall and a box wall connected thereto;

a lid having a top wall and a lid wall connected thereto; and hinge means for pivotally connecting said box wall to said lid wall at a first selected location with respect thereto so that said lid is selectively openable with respect to said box whereupon said lidded box is selectively switchable from being in a closed configuration to being in an open configuration;

a pre-inked stamp connected with said box and at least in part located therewithin, said pre-inked stamp having a contoured contact surface for imparting a postage stamp cancellation ink mark on a surface brought into selected contact therewith when said lidded box is in said open configuration; and connection means for connecting said box to a selected surface of said postal satchel means so that said bottom wall faces toward said selected surface.

12. The combination of claim 11, wherein said box wail terminates in a periphery remote from said bottom wall; wherein further said contoured contact surface is located further from said bottom wall than said periphery is located from said bottom wall.

13. The combination of claim 12, wherein said postal satchel means has at least one surface which is substantially vertical when said opening is substantially horizontal; and wherein said box is connected to said at least one surface such that said hinge means is vertically at a lowest location of said lidded box.

14. The combination of claim 13, wherein said at least one surface comprises a forward facing, exterior surface of said postal satchel means.

15. The combination of claim 14, further comprising snap means connected with said box wall and said lid wall at a second selected location opposite said first selected location for providing a releasable snap closure of said lid with respect to said box; said hinge means being vertically beneath said snap means when said opening is substantially horizontal.

16. The combination of claim 15, wherein said snap means further comprises touch tab means connected with said lid wall for facilitating releasing of said snap closure.

17. The combination of claim 16, further comprising lip means connected with said lip wall for overlapping at least a portion of said box wall when said lidded box is in said closed configuration to thereby provide a weather seal between said box and said lid.

18. The combination of claim 17, wherein said connection means comprises adhesive means.

19. The combination of claim 18, wherein said pre-inked stamp has a bottom side; and wherein said bottom side is adhesively connected with said bottom wall of said box.

20. The combination of claim 19, wherein said contoured contact surface comprises a plurality of ridges, each ridge of said plurality of ridges terminating in an apex; wherein each said apex is located further from said bottom wall than said periphery is located from said bottom wall.

* * * * *